US008022561B2

(12) United States Patent
Ciglenec et al.

(10) Patent No.: US 8,022,561 B2
(45) Date of Patent: Sep. 20, 2011

(54) KINETIC ENERGY HARVESTING IN A DRILL STRING

(75) Inventors: Reinhart Ciglenec, Katy, TX (US); Albert Hoefel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 591 days.

(21) Appl. No.: 12/101,824

(22) Filed: Apr. 11, 2008

(65) Prior Publication Data

US 2009/0256532 A1 Oct. 15, 2009

(51) Int. Cl.
*F03B 13/00* (2006.01)

(52) U.S. Cl. ..... 290/1 R

(58) Field of Classification Search ..... 290/43, 290/54, 1 R; 166/65.1, 66.5; 175/40, 93; 367/81, 83

See application file for complete search history.

(56) References Cited

U.S. PATENT DOCUMENTS

| | | | | |
|---|---|---|---|---|
| 5,248,896 | A | 9/1993 | Forrest | |
| 6,191,561 | B1 | 2/2001 | Bartel | |
| 6,554,074 | B2 | 4/2003 | Longbottom | |
| 7,002,261 | B2 * | 2/2006 | Cousins | 290/54 |
| 7,013,989 | B2 * | 3/2006 | Hammond et al. | 175/40 |
| 7,133,325 | B2 * | 11/2006 | Kotsonis et al. | 367/83 |
| 7,230,346 | B2 * | 6/2007 | Mahowald | 290/43 |
| 7,537,051 | B1 * | 5/2009 | Hall et al. | 166/65.1 |
| 7,537,053 | B1 * | 5/2009 | Hall et al. | 166/242.6 |
| 7,671,480 | B2 * | 3/2010 | Pitchford et al. | 290/43 |
| 7,723,860 | B2 * | 5/2010 | Nagler | 290/54 |
| 2006/0113803 | A1 * | 6/2006 | Hall et al. | 290/54 |
| 2008/0128123 | A1 * | 6/2008 | Gold | 166/66 |
| 2008/0247273 | A1 * | 10/2008 | Chemali et al. | 367/82 |

* cited by examiner

*Primary Examiner* — Tho D Ta

(74) *Attorney, Agent, or Firm* — John Vereb; Jeremy Welch

(57) ABSTRACT

An apparatus and method for harvesting energy in a wellbore is disclosed. In one embodiment, a harvester tool positioned in a wellbore for capturing energy in the wellbore is disclosed. The harvester tool includes a rotor comprising a magnet. The magnet is disposed eccentric to a center of the harvester tool. In addition, the rotor is rotatable around the center of the harvester tool. The harvester tool also includes a stator. Rotation of the rotor induces a voltage in the stator.

20 Claims, 6 Drawing Sheets

KINETIC ENERGY HARVESTING IN A DRILL STRING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates to the field of wellbore drilling and more specifically to the field of harvesting energy in a wellbore.

2. Background of the Invention

Wells are generally drilled into the ground to recover natural deposits of hydrocarbons and other desirable materials trapped in geological formations in the Earth's crust. A well is typically drilled using a drill bit attached to the lower end of a drill string. The well is drilled so that it penetrates the subsurface formations containing the trapped materials for recovery of the trapped materials. The bottom end of the drill string conventionally includes a bottomhole assembly that has sensors, control mechanisms, and associated circuitry and electronics. As the drill bit is advanced through the formation, drilling fluid (e.g., drilling mud) is pumped from the surface through the drill string to the drill bit. The drilling fluid exits the drill bit and returns to the surface. The drilling fluid cools and lubricates the drill bit and carries the drill cuttings back to the surface. Electrical power is typically used to operate the sensors, circuitry and electronics in the bottomhole assembly. Electrical power is conventionally provided by batteries in the bottomhole assembly. Drawbacks to batteries include maintaining a charge in the batteries. Electrical power has also been conventionally provided by pipe internal mud flow, which may be directed through a turbine with an alternator. Drawbacks to the turbine include location of the turbine in the center of the mud flow, which does not allow downhole tools to pass the turbine.

Consequently, there is a need for an improved method of providing electrical power downhole. In addition, there is a need for an improved method of capturing energy downhole.

BRIEF SUMMARY OF SOME OF THE PREFERRED EMBODIMENTS

These and other needs in the art are addressed in one embodiment by a harvester tool positioned in a wellbore for capturing energy in the wellbore. The harvester tool includes a rotor comprising a magnet. The magnet is disposed eccentric to a center of the harvester tool. In addition, the rotor is rotatable around the center of the harvester tool. The harvester tool also includes a stator. Rotation of the rotor induces a voltage in the stator.

In another embodiment, these and other needs in the art are addressed by a method of capturing energy from a drill string in a wellbore. The method includes providing a harvester tool in the wellbore. The harvester tool comprises a rotor and a stator. The rotor comprises a magnet disposed eccentric to a center of the harvester tool. The method also includes rotating the harvester tool in an eccentric motion. In addition, the method includes rotating the magnet around the center of the harvester tool. The method further includes inducing a voltage in the stator. Rotation of the rotor induces a voltage in the stator.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

Figure 1:
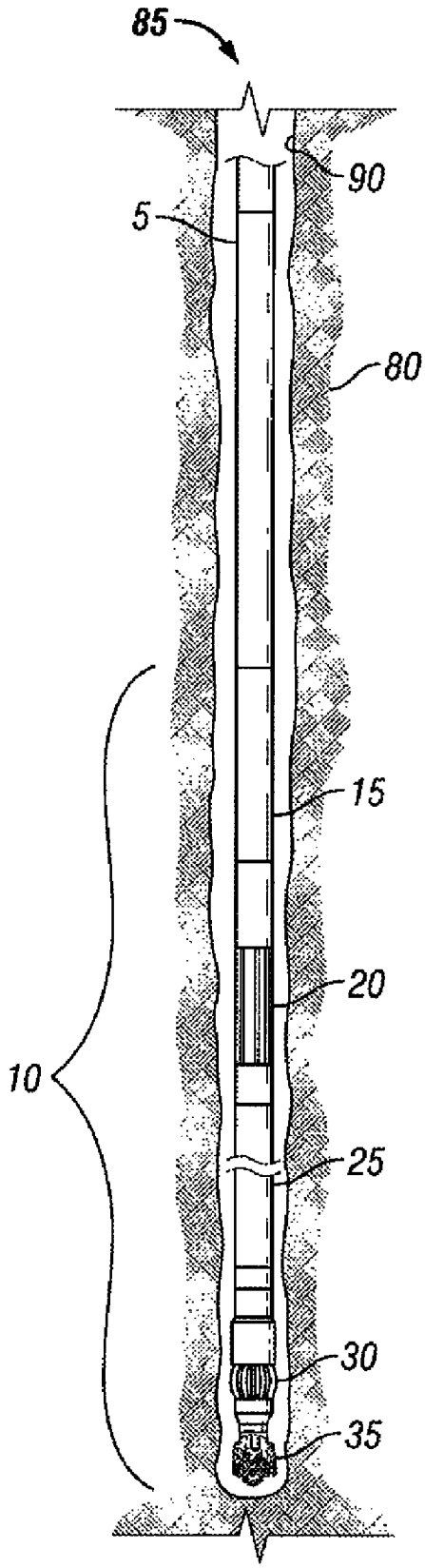
FIG. 1 illustrates a drill string with a bottomhole assembly having a harvester tool.

FIG. 1 illustrates drill string 5 disposed in wellbore 85 of formation 80. It is to be understood that only a portion of drill string 5 is shown in FIG. 1 for illustration purposes only. Drill string 5 is suspended within wellbore 85 and includes bottomhole assembly 10. Bottomhole assembly 10 includes drill bit 35 at its lower end. Bottomhole assembly 10 also includes harvester tool 15; downhole tools 20, 25; and near bit stabilizer 30. Downhole tools 20, 25 may include any tool suitable for use in wellbore 85. For instance, downhole tools 20, 25 may include logging-while-drilling tools, measuring-while-drilling tools, and the like. Bottomhole assembly 10 is not limited to having only downhole tools 20, 25 but instead may have any desirable amount of downhole tools. In addition, bottomhole assembly 10 may also have other components such as stabilizers, an interface sub, a mud motor, drill collars, and the like. Harvester tool 15 may be disposed at any location within bottomhole assembly 10 suitable for the harvesting of energy. For instance, in an embodiment (not illustrated) in which a mud motor is used for drilling, harvester tool 15 may be located between the mud motor and drill bit 35.

Figure 2:
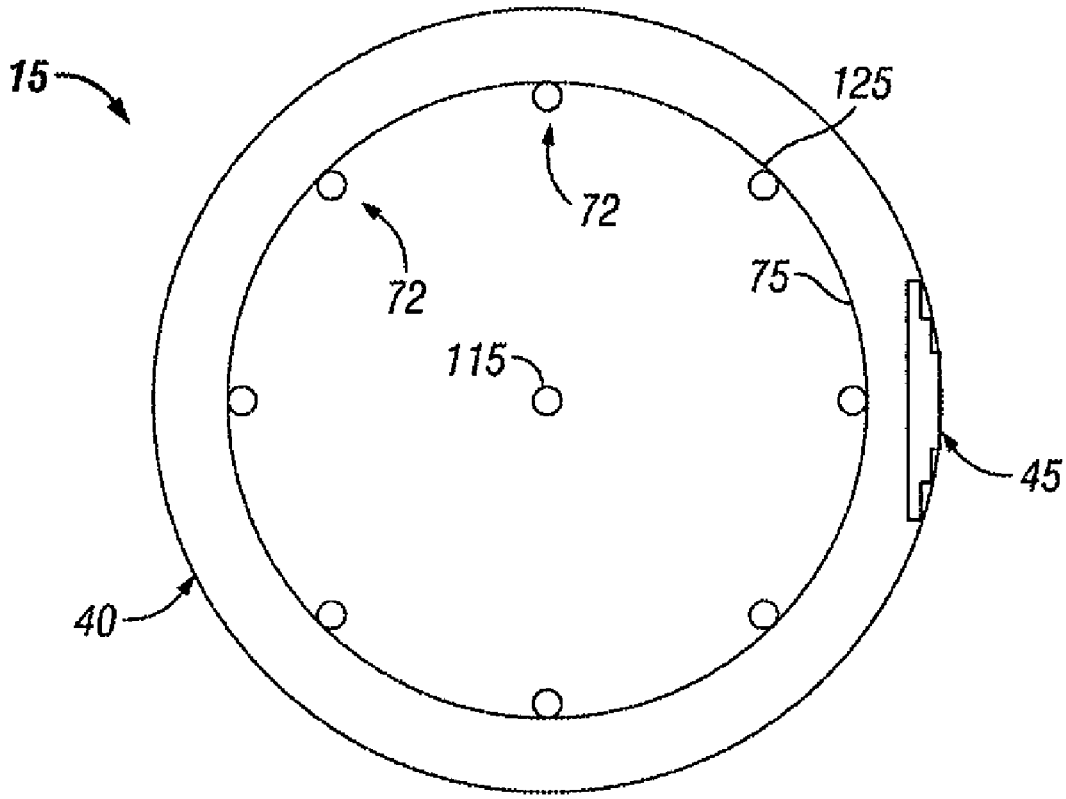
FIG. 2 illustrates a top cross sectional view of a stator and a rotor having an eccentric magnet.
Figure 3:
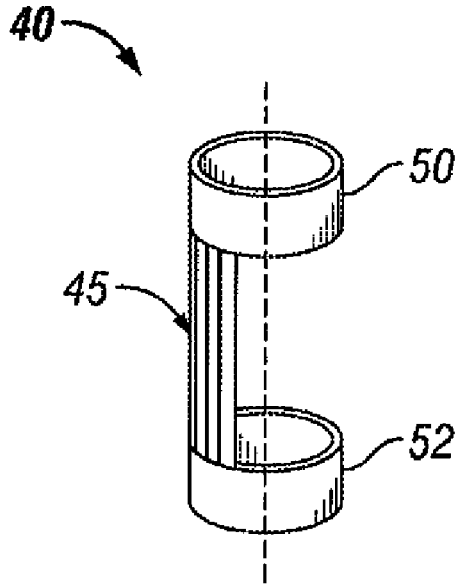
FIG. 3 illustrates a side perspective view of a rotor with an eccentric magnet.

FIG. 2 illustrates a cross sectional top view of an embodiment of harvester tool 15 having rotor 40 and stator 75. In such an embodiment, stator 75 is disposed within an interior 125 of rotor 40. Rotor 40 is rotatable about stator 75. FIG. 2 illustrates an embodiment of harvester tool 15 in which rotor 40 includes magnet 45. In an embodiment, magnet 45 is a permanent magnet. Magnet 45 may be composed of any materials suitable for use in a drill string. For instance, magnet 45 may be composed of iron, cobalt, nickel, rare earth elements, or any combination thereof. In the embodiment as illustrated in FIG. 2, rotor 40 includes one magnet 45. However, rotor 40 is not limited to one magnet 45 but may include any desirable number of magnets 45 suitable for disposition on rotor 40. In some embodiments, magnet 45 is a two pole permanent magnet (e.g., has a north and a south pole). FIG. 3 illustrates an embodiment of rotor 40 in which rotor 40 includes one magnet 45. Magnet 45 may have any weight suitable for capturing energy with harvester tool 15. In addition, magnet 45 may have any configuration suitable for use with rotor 40. In an embodiment as illustrated in FIG. 3, magnet 45 may extend longitudinally along rotor 40. As shown, rotor 40 may include sleeve ends 50, 52 disposed at opposing ends of rotor 40. Magnet 45 is secured to sleeve ends 50, 52 by any suitable means such as adhesive. It is to be understood that the dashed line represents the center longitudinal axis of rotor 40. Magnet 45 is disposed eccentric to harvester tool center 115 as shown in FIG. 2. Magnet 45 may be disposed at any desirable location on rotor 40 eccentric to harvester tool center 115. In an alternative embodiment (not illustrated), rotor 40 may also include an eccentric mass or more than one eccentric mass. In an embodiment (not illustrated), harvester tool 15 has a housing in which rotor 40 and stator 75 are disposed. The housing may be composed of any material and have any configuration suitable for use in drill string 5. Some embodiments include the housing being composed of materials with different densities and an uneven distribution to achieve rotational eccentricity. In an embodiment, harvester tool 15 may have an annular design. In some embodiments, harvester tool 15 may be a drill collar or any other suitable component of bottomhole assembly 10. For instance, in an embodiment as illustrated in FIG. 1, harvester tool 15 has a drill collar design. In such an embodiment, mud flow may be in the center of harvester tool 15. Without limitation, such a configuration may reduce erosion from the mud and may not require seals because rotor 40 is not exposed to the mud. In some embodiments, harvester tool 15 may have an annular electronic chassis (not illustrated) to allow maximum eccentricity of magnet 45 and/or eccentric mass 55. Without being limited by theory, any mass that is unequally distributed over the circumference of a cylindrical shell results in rotational eccentricity. Further, without being limited by theory, maximum eccentricity may be provided by an annular chassis because the annular chassis has a large useable diameter, which allows the center of an eccentric mass and/or magnet 45 to be placed a further distance from harvester tool center 115. It is to be understood that providing the maximum eccentricity allows more inertia for an eccentric mass or magnet 45 (i.e., the maximum transferable torque is proportional to the inertia). In an alternative embodiment of FIG. 2, harvester tool 15 includes an eccentric mass (e.g., eccentric mass 55) in place of magnet 45. The eccentric mass is coupled to rotor 40. In such an alternative embodiment, the parameters of harvester tool 15 may be adjusted to a desired speed and voltage range. In some alternative embodiments, the eccentric mass is coupled to rotor 40 by a gear box (not illustrated).

In an embodiment (not illustrated), rotor 40 is supported by bearings. Any bearings suitable for allowing rotor 40 to freely rotate about harvester tool center 115 may be used. In an embodiment, the bearings are rolling-element bearings such as ball bearings. The ball bearings may be composed of any material suitable for use in a downhole tool. For instance, the ball bearings may be composed of steel, ceramic, and the like. In addition, the ball bearings may have any type of construction suitable for an electrical generator and for allowing rotor 40 to freely rotate about harvester tool center 115 and stator 75. Without limitation, examples of suitable construction include caged bearings, cone construction bearings, and cup and cone ball bearings.

Figure 4:
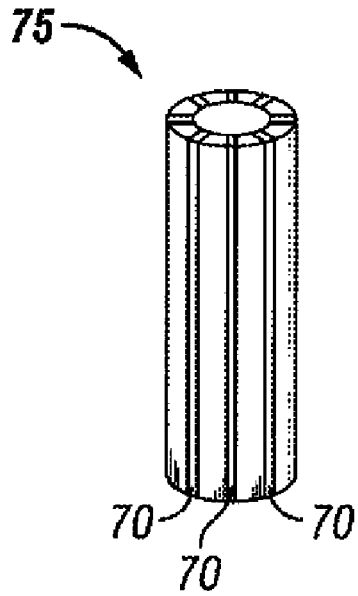
FIG. 4 illustrates a side perspective view of a stator.
Figure 5:
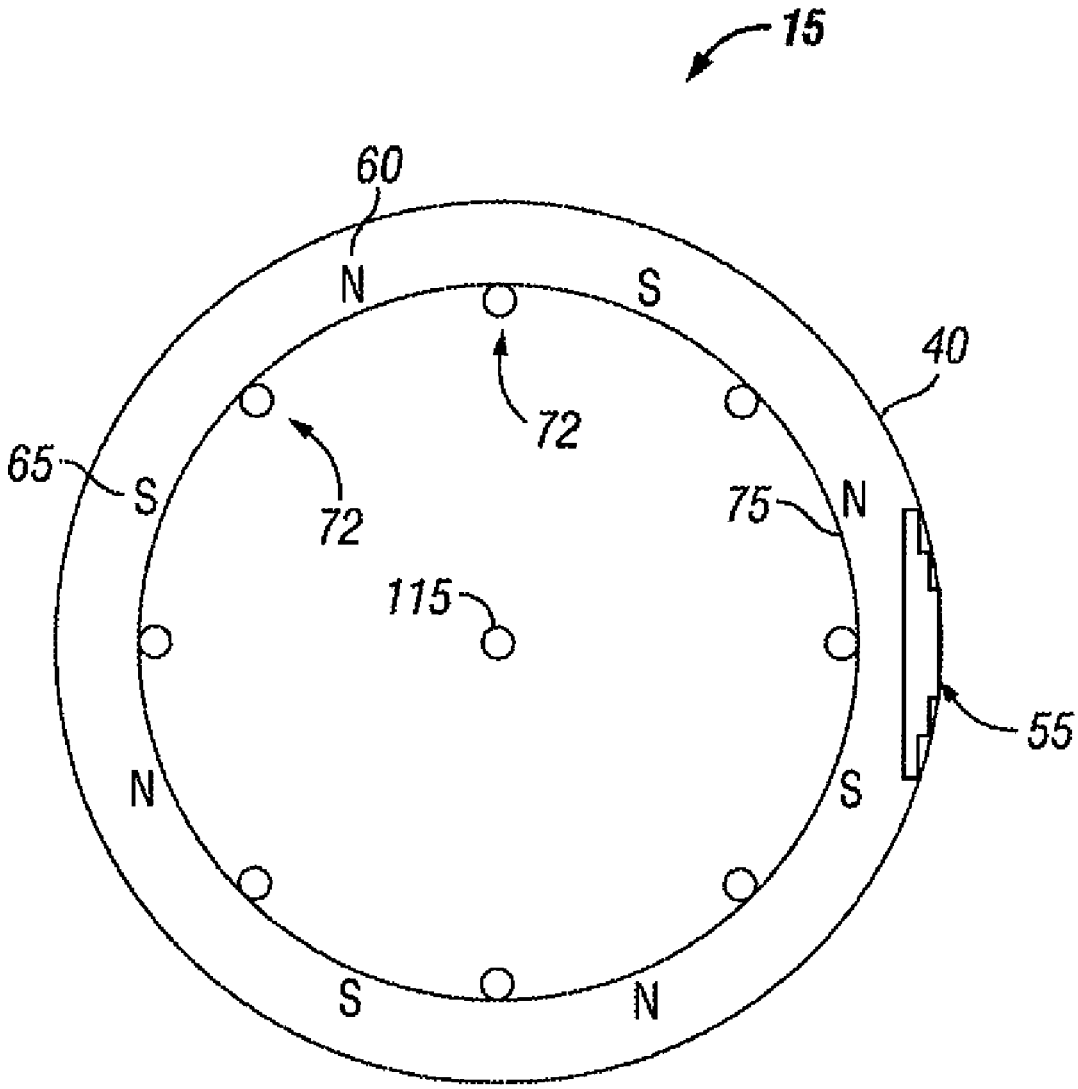
FIG. 5 illustrates a top cross sectional view of a stator and a rotor having magnets and an eccentric mass.

FIG. 4 illustrates an embodiment of stator 75 having a plurality of slots 70 in the surface of stator 75. Slots 70 may extend longitudinally along stator 75. In an embodiment, stator windings 72 are disposed in slots 70 and extend lengthwise along stator 75. Stator windings 72 are shown in FIGS. 2 and 5. Slots 70 may have any depth and width suitable for stator windings 72. Stator windings 72 may include any electrically conductive materials or combinations of such materials. Without limitation, examples of such materials include copper and aluminum. Stator windings 72 may be of any shape suitable for use in capturing energy with stator 75 such as a wire. Stator 75 may also have any desired phase of stator windings 72. In an embodiment, stator 75 has three phase stator windings 72. It is to be understood that stator 75 may have any other components suitable for a stator of an electrical generator such as associated electronics. Stator 75 may be composed of any material suitable for use with an electrical generator such as metal. In an embodiment as illustrated in FIGS. 2-4, stator 75 may have any configuration suitable for disposition within interior 125 of rotor 40.

Figure 6:
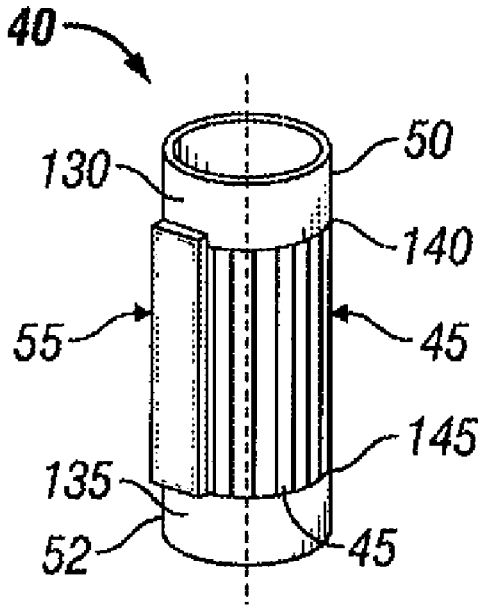
FIG. 6 illustrates a side perspective view of a rotor having magnets and an eccentric mass.

FIGS. 5 and 6 illustrate an embodiment of harvester tool 15 in which rotor 40 includes a plurality of magnets 45 and eccentric mass 55. FIG. 5 illustrates a top cross-sectional view of harvester tool 15. The housing is not shown for illustration purposes only. In FIG. 5, north poles 60 and south poles 65 of magnets 45 are shown instead of magnets 45 for illustration purposes only. In such an embodiment, magnets 45 are two pole magnets. In an embodiment, magnets 45 are disposed eccentric to harvester tool center 115. Eccentric mass 55 is also disposed eccentric to harvester tool center 115. Eccentric mass 55 may be disposed at any suitable location on rotor 40 eccentric to harvester tool center 115. FIG. 6 illustrates an embodiment of rotor 40 in which eccentric mass 55 is disposed at a distance farther from harvester tool center 115 than magnets 45. Without being limited by theory, such an embodiment provides maximum inertia. Eccentric mass 55 may be secured to rotor 40 by any suitable means such as by adhesive. In an alternative embodiment (not illustrated), rotor 40 includes more than one eccentric mass 55. Eccentric mass 55 may have any shape and composition suitable for use in a rotor of an electrical generator. It is to be understood that an eccentric mass 55 composed of heavier materials may provide more inertia for the same volume. In an embodiment as illustrated in FIG. 6, eccentric mass 55 extends lengthwise along rotor 40. Eccentric mass 55 may have any weight suitable for capturing energy with harvester tool 15. In an embodiment, eccentric mass 55 may be secured to an exterior surface 130, 135 of sleeve ends 50, 52, respectively. In an alternative embodiment (not illustrated), eccentric mass 55 is secured to edge portions 140, 145 of sleeve ends 50, 52. In other alternative embodiments (not illustrated), harvester tool 15 includes a plurality of magnets 45 but does not include eccentric mass 55.

It is to be understood that the speed of rotor 40 relative to stator 75 may define the induced stator voltage generated by harvester tool 15. In an embodiment in which the induced voltage drives a load current, a load torque on rotor 40 is created that is proportional to the load current. It is to be further understood that an eccentric mass (e.g., magnet 45) coupled to a rotating harvester tool 15 may spin relative to rotating harvester tool 15 in an embodiment in which harvester tool 15 follows an eccentric motion such as rolling along wellbore wall 90 as shown in FIG. 1. Magnet 45 spinning relative to harvester tool center 115 and stator 75 may be used to generate electrical power in harvester tool 15. Without being limited by theory, the actual harvester tool 15 motion determines the amount of power that may be transferred from the eccentric rotation of harvester tool 15 to magnet 45 disposed inside harvester tool 15.

Figure 7:
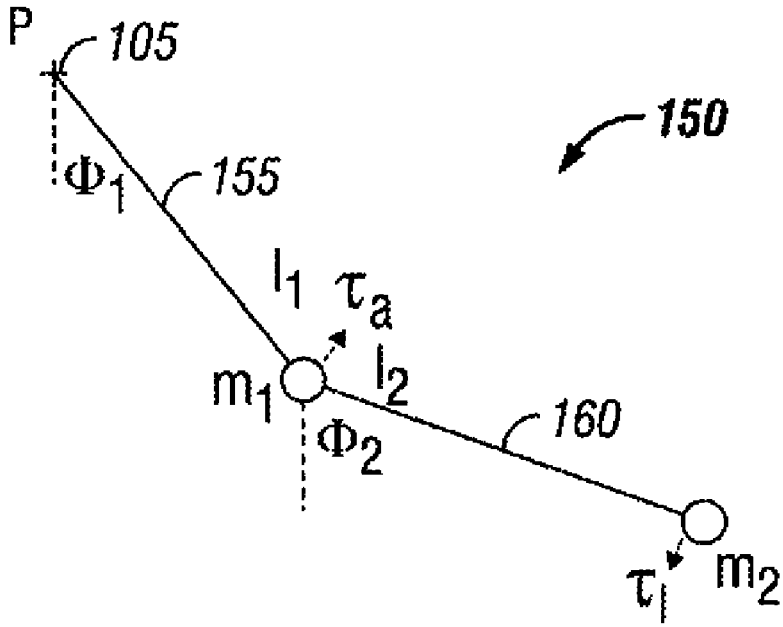
FIG. 7 illustrates a model of an eccentric two mass system.

The eccentric mass or masses provide an unbalanced rotor 40. The eccentric masses may be magnet 45 and/or eccentric mass 55. In an embodiment, the energy transfer from the inertia of unbalanced rotor 40 in harvester tool 15 that is rotating along wellbore wall 90 may be determined from an energy transfer model. Without limitation, energy transfer of harvester tool 15 may be more efficient with a higher overall imbalance. It is to be understood that the model assumes an eccentric mass point with an equivalent inertia that has a stiff coupling to harvester tool center 115. The energy transfer model may be derived from a coupled two mass system 150 as illustrated in FIG. 7. It is to be understood that FIG. 7 is an illustrated model of a coupled two mass system. As illustrated, mass $m_1$ is coupled to a fixed point P (reference 105) by a stiff connection 155 with length $l_1$. Mass $m_1$ is coupled to eccentric mass $m_2$ by eccentric mass stiff connection 160 with length $l_2$. It is to be understood that stiff connections 155, 160 are part of the theoretical model and refer to non-flexible (i.e., non-bending). As illustrated in FIG. 7, mass $m_1$ is accelerated by actuation torque, $\tau_a$. Actuation torque $\tau_a$ is determined by Equation (1).

$$(m_1+m_2)l_1^2\ddot{\Phi}_1+m_2l_1l_2\ddot{\Phi}_2\cos(\Phi_1-\Phi_2)+m_2l_1l_2\dot{\Phi}_2^2\sin(\Phi_1-\Phi_2)=\tau_a \quad \text{Equation (1)}$$

In Equation (1), $\Phi_1$ is the angle of stiff connection 155 in relation to fixed point P, and $\Phi_2$ is the angle of eccentric mass stiff connection 160 in relation to mass $m_1$. It is to be understood that $\dot{\Phi}_1$ and $\dot{\Phi}_2$ are the first derivatives to time, respectively, and $\ddot{\Phi}_1$ and $\ddot{\Phi}_2$ are the second derivatives to time, respectively. Mass $m_2$ is accelerated by load torque $\tau_1$. Load torque $\tau_1$ is determined by Equation (2).

$$m_2l_2^2\ddot{\Phi}_2+m_2l_1l_2\ddot{\Phi}_1\cos(\Phi_1-\Phi_2)-m_2l_1l_2\dot{\Phi}_1^2\sin(\Phi_1-\Phi_2)=-\tau_1 \quad \text{Equation (2)}$$

Equations (1) and (2) describe actuation torque $\tau_a$ and load torque $\tau_1$ for two coupled free masses. To describe the load torque $\tau_1$ for an eccentric mass (e.g., magnet 45 or eccentric mass 55) in rotating harvester tool 15, additional constraints are considered. Additional constraints include rotation of harvester tool 15 not being a free rotation but instead being defined by conditions such as conditions of wellbore 85 and drill string 5. For instance, such conditions may include forces at the surface of wellbore 85. The conditions may also include interactions between bottomhole assembly 10 components (e.g., centralizers) and wellbore wall 90. Without being limited by theory, motion of the eccentric mass is dependent upon motion of harvester tool 15, but motion of the eccentric mass has substantially no impact on motion of harvester tool 15. Therefore, to describe the load torque $\tau_1$ for an eccentric mass (e.g., magnet 45 or eccentric mass 55), the solution of Equation (2) may be used instead of Equation (1). Without being limited by theory, the solution of Equation (2) may be used because Equation (1) describes the dependency of harvester tool 15 angular acceleration on a coupled mass motion or load. Further, without being limited by theory, Equation (1) may only provide actuation torque $\tau_a$ as a response to a load torque $\tau_1$.

Figure 8:
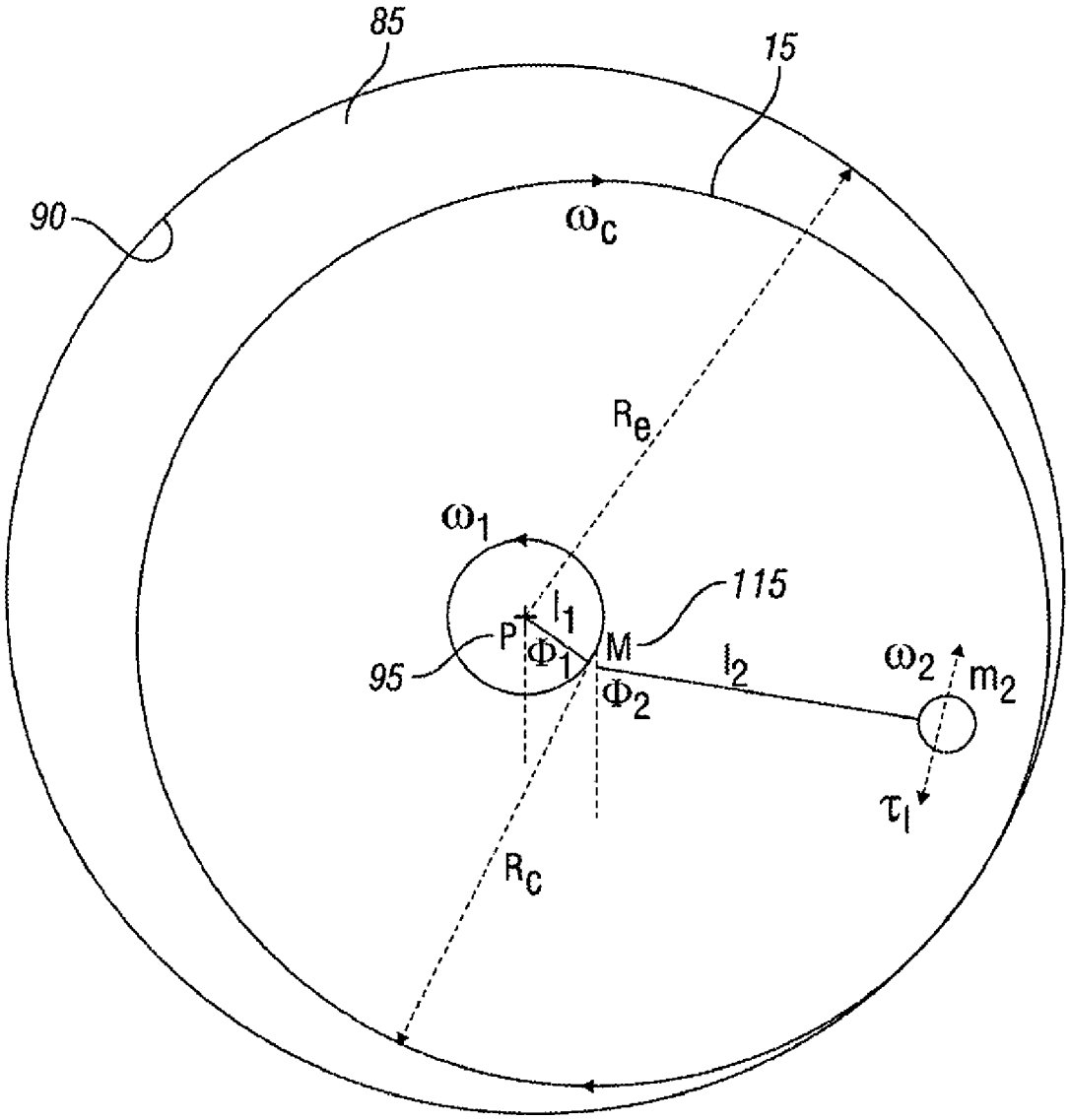
FIG. 8 illustrates a model of an eccentric mass system in a harvester tool rolling along a borehole wall.

FIG. 8 illustrates an embodiment of a model of harvester tool 15 rolling along wellbore wall 90. It is to be understood that the embodiment illustrated in FIG. 8 is not a two mass system and therefore does not have mass $m_1$. Instead of mass $m_1$, the model has harvester tool center 115 (represented by reference M). In the embodiment illustrated in FIG. 8, fixed point P represents the center of wellbore 85, which is wellbore center 95. Harvester tool center 115 is not connected to wellbore center 95 by a stiff connection. In addition, mass $m_2$ is not connected to harvester tool center 115 by a stiff connection. In an embodiment in which angle $\Phi_1$ is available, the solution of Equation (2) provides the result for $\omega_2$ as a function of load torque $\tau_1$. In an embodiment in which $\omega_c$ is available, Equation (2) determines the available load torque $\tau_1$. It is to be understood that the motion of eccentric mass $m_2$ may stall and run synchronous with $\omega_c$ in an instance in which the load torque $\tau_1$ is too high, which results in substantially no voltage induction in stator 75 because motion between rotor 40 and stator 75 induces voltage. Without being limited by theory, a general solution for Equation (2) is not available because the solution depends upon motion of harvester tool 15. However, it has been discovered that the limits of energy transfer may be determined by applying steady state conditions to Equation (2) with motion of harvester tool 15 such as harvester tool 15 rolling along wellbore wall 90 as illustrated in FIG. 8. In FIG. 8, $R_C$ refers to harvester tool 15 radius, $R_B$ refers to wellbore 85 radius, 12 refers to the distance of magnet 45 from harvester tool center 115 (reference M), 11 refers to the distance of harvester tool center 115 from wellbore center 95 (reference P), $\omega_2$ refers to angular velocity of eccentric mass $m_2$ around harvester tool center 115, $\omega_1$ refers to the angular velocity of harvester tool center 115 (reference M) around the center of wellbore 85 (reference fixed point P), $\omega_c$ refers to harvester tool 15 rotation angular velocity, $\Phi_1$ refers to the angle of harvester tool center 115 to wellbore center 95, $\Phi_2$ refers to the angle of mass $m_2$ to harvester tool center 115, and $m_2$ is weight of an eccentric mass. Eccentric mass $m_2$ may be a magnet 45 or eccentric mass 55. It is to be understood that Equations (1), (2) account for more than one eccentric mass as each object (i.e., eccentric mass, connectors, harvester tool 15 parts, etc.) are coupled in a stiff arrangement providing the system with one center of gravity. It is to be further understood that the complete system has one center of gravity and for the purpose of calculation, it is considered that the complete mass of the system is acting at the center of gravity. The steady state solution of Equation (2) for forced motion of harvester tool 15 around wellbore center 95 is shown by Equation (3). It is to be understood that forced motion refers to confinement of the rotation of the eccentric mass to around its respective center axis.

$$-m_2l_1l_2\dot{\Phi}_1^2\sin(\Phi_1-\Phi_2)=-\tau_1 \quad \text{Equation (3)}$$

The steady state solution of Equation (2) to provide Equation (3) is shown by Equations (4)-(7), which provide Equation (3) when applied to Equation (2). It is to be understood that the second derivative is zero for the steady state.

$$\omega_1=\omega_2 \quad \text{Equation (4)}$$

$$\omega_1=\frac{d\Phi_1}{dt} \quad \text{Equation (5)}$$

$$\omega_2=\frac{d\Phi_2}{dt} \quad \text{Equation (6)}$$

$$\sin(\Phi_1-\Phi_2)=\frac{\tau_1}{m_2l_1l_2\omega_1^2} \quad \text{Equation (7)}$$

It has been found that the eccentric mass $m_2$ (e.g., magnet 45 or eccentric mass 55) follows the motion of harvester tool center 115 with a −180° phase shift in an embodiment in which no load is applied. For 0° and 180°, load torque $\tau_1$ is zero, which provides $\sin(\Phi_1-\Phi_2)$ at zero. In an embodiment in which load torque $\tau_1$ is applied, the angle difference $(\Phi_1-\Phi_2)$ is reduced because the angle difference follows the load torque $\tau_1$ in Equation (7). In such an embodiment, the maximum value of load torque $\tau_1$ ($\tau_{1max}$) is determined by Equation (8). It is to be understood that the maximum value occurs when $\sin(\Phi_1-\Phi_2)=1$, as the sinus cannot be larger than one. Without being limited by theory, if load torque $\tau_1$ is too large, the eccentric mass has no motion relative to harvester tool 15 and will stall at a 90° angle.

$$m_2 l_1 l_2 \omega_1^2 = \tau_{1max} \quad \text{Equation (8)}$$

It has also been found that at an increased load torque $\tau_1$, angular velocity $\omega_2$ may stop following angular velocity $\omega_1$ and may be substantially similar to angular velocity $\omega_C$. In an embodiment in which stator 75 is rotating at the velocity of harvester tool 15, voltage is not induced. It is to be understood that when there is no relative motion between magnet 45 and harvester tool 15, no voltage is generated and both rotate relative to the outside at $\omega_c$. In addition, the angle between $\Phi_1$ and $\Phi_2$ is $\Phi_1-\Phi_2$, which varies as a function of load torque $\tau_1$. Therefore, the maximum steady state load torque $\tau_1$ achieved when $\sin(\Phi_1-\Phi_2)$ is 1. Equation (9) is the steady state solution at maximum load torque $\tau_{1max}$ of Equation (2) for eccentric motion of harvester tool 15 in wellbore 85 (e.g., rolling along wellbore wall 90). Equations (10)-(11) are applied to Equation (2) to provide Equation (9).

$$m_2 l_1 l_2 \omega_c^2 \left(\frac{R_c}{R_B}\right)^2 > \tau_1 \quad \text{Equation (9)}$$

$$\omega_1 = -\omega_c * \frac{R_c}{R_B} \quad \text{Equation (10)}$$

$$\Phi_1 - \Phi_2 = \arcsin\left(\frac{\tau_1}{m_2 l_1 l_2 \omega_c^2 \left(\frac{R_c}{R_B}\right)^2}\right) \quad \text{Equation (11)}$$

The power output $P_{max}$ of harvester tool 15 for a given load torque $\tau_1$ may be determined by applying the result of Equation (9) to Equation (12).

$$P_{max} = \tau_1 \omega_2 (1+(R_C/R_B)^2) \quad \text{Equation (12)}$$

In an embodiment, as shown by Equations (9)-(12), an increase in the weight of mass $m_2$ results in an increase in the power output $P_{max}$ as determined by Equation (12).

In other embodiments, load torque $\tau_1$ corresponds to load current $I_{load}$ that is in phase with the induced open terminal voltage $U_{ind}$. Without being limited by theory, in permanent magnet alternators, the alternative phase current is proportional to the load torque. $I_{load}$ and $U_{ind}$ are determined by Equations (13) and (14), respectively.

$$U_{ind_tt} = K_c(\omega_2 - \omega_c) = K_c \omega_c \left(1 + \left(\frac{R_c}{R_B}\right)^2\right) \quad \text{Equation (13)}$$

$$I_{load_max} = \frac{K_t}{\tau_{1max}} \quad \text{Equation (14)}$$

In Equations (13) and (14), $K_C$ refers to the voltage constant (i.e., in V/(rad/s), and $K_t$ refers to the torque constant (i.e., in Nm/A). It is to be understood that tt refers to the terminal phase to phase voltage, with a Y configuration of a three phase alternator assumed. $\tau_{1max}$ refers to maximum load torque, which is determined by Equation (8).

In some embodiments, additional power $P_{add}$ is available for harvester tool 15. For instance, gravity has an impact on the additional power $P_{add}$ available. Gravity has the impact dependent on inclination of harvester tool 15. Therefore, a rotating harvester tool 15 with inclination angle θ may drive load torque $\tau_1$ as determined by Equation (15).

$$m_2 l_2 \sin(\theta) < \tau_1 \quad \text{Equation (15)}$$

Because the rotating harvester tool 15 with inclination angle θ may drive load torque $\theta_1$, the additional power $P_{add}$ is available to harvester tool 15 as shown by Equation (16). θ is the inclination of harvester tool 15 relative to the gravity field. For instance, 90° refers to a horizontal well, and 0° refers to a vertical well.

$$\omega_c m_2 l_2 \sin(\theta) < P_{add} \quad \text{Equation (16)}$$

Harvester tool 15 may harvest various types of kinetic energy in drill string 5. For instance, the rolling motion along wellbore wall 90 is modeled by Equations (9)-(11). Without being limited by theory, the actual drilling induced motion of harvester tool 15 may not be as continuous and smooth as shown by the theoretical model of Equations (9)-(11). Further, without being limited by theory, the rough and erratic contacts in wellbore 85 may result in a more efficient ability to transfer energy than modeled by the equations. For instance, shocks applied from various angles may generate forces on the eccentric mass (e.g., magnet 45 or eccentric mass 55) that may drive electric loads.

It is to be understood that harvester tool 15 is not limited to stator 75 disposed within interior 125 of rotor 40. In alternative embodiments (not illustrated), rotor 40 may be disposed within an interior of stator 75.

In an alternative embodiment (not illustrated), magnet 45 is embedded in an orthogonal axis with stator windings 72 in an opposite direction.

Power provided by harvester tool 15 may be used for any suitable power need in drill string 5. For instance, harvester tool 15 may provide power to logging-while-drilling tools and measuring-while-drilling tools. In some embodiments, harvester tool 15 may be used in areas of drill string 5 not available for power supply from a turbine. In an embodiment, harvester tool 15 may be used to charge batteries.

In some embodiments, the geometry of harvester tool 15 is optimized. For instance, actual drilling data may be used (i.e., actual acceleration and rotational measurements may be made). From the data log of such data, the maximum energy transfer may be modeled. An alternator (i.e., harvester tool 15) may be designed to the resulting speed and torque range, with the requirement for the voltage regulation of the alternator output voltage desired.

To further illustrate various illustrative embodiments of the present invention, the following prophetic example is provided.

EXAMPLE

In the prophetic example, the resulting power was determined for harvester tool 15 rolling in wellbore 85 as shown by the model of FIG. 8. $R_C$ was 0.17 m, $R_B$ was 0.216 m, $m_2$ was 1 kg, $l_2$ was 0.055 m, $l_1$ was 0.023 m, $\omega_2$ was 180 rpm, and $\Phi_2$ was determined by 9*4π. $\omega_2$ was converted to Hz (Hertz units) by multiplying 3 Hz by 2π. Equation (9) was used to determine the load torque $\tau_1$ as shown by the following determination.

$$\tau_1=1\ \text{kg}*0.023\ \text{m}*0.055\ \text{m}*(9*4*7)^2*(0.17\ \text{m}/0.216\ \text{m})^2=0.278\ \text{Nm}$$

The determined load torque $\tau_1$ of 0.278 Nm was applied to Equation (12) to determine $P_{max}$ as shown by the following determination.

$$P_{max}=0.278*3*2*\pi*(1+(0.17/0.216)^2)=8.5\ \text{W}$$

A further determination was made with $\omega_2$ of 300 rpm, which using Equations (9) and (12) resulted in a load torque $\tau_1$ of 0.773 Nm and resulting power Pa of 40 W. The increase in $\omega_2$ resulted in an increase in the resulting power levels.

Although the present invention and its advantages have been described in detail, it should be understood that various changes, substitutions and alterations may be made herein without departing from the spirit and scope of the invention as defined by the appended claims.

What is claimed is:

1. A harvester tool positioned in a wellbore for capturing energy in the wellbore, comprising:

a rotor having a mass or a magnet, wherein the magnet is disposed eccentric to a center of the harvester tool, and wherein the rotor is rotatable around the center of the harvester tool, and further wherein the magnet or the mass is positioned on the rotor such that the rotor has an uneven mass distribution about a perimeter of the rotor causing rotation of the rotor to be eccentric rotation; and a stator, wherein rotation of the rotor induces a voltage in the stator.

2. The harvester tool of claim 1, wherein the rotor is rotatable about the stator.

3. The harvester tool of claim 1, wherein the magnet is a permanent magnet.

4. The harvester tool of claim 1, further comprising bearings, wherein the bearings allow the rotor to rotate about the center of the harvester tool.

5. The harvester tool of claim 1, wherein the stator comprises stator windings.

6. The harvester tool of claim 1, wherein the rotor comprises a plurality of magnets.

7. The harvester tool of claim 1, wherein the rotor further comprises an eccentric mass, wherein the eccentric mass is disposed eccentric to the center of the harvester tool.

8. The harvester tool of claim 1, wherein the harvester tool is rotatable in an eccentric motion in the wellbore.

9. A method of capturing energy from a drill string in a wellbore, comprising:

providing a harvester tool in the wellbore, wherein the harvester tool comprises a rotor and a stator, and wherein the rotor comprises a magnet disposed eccentric to a center of the harvester tool such that the rotor has an uneven mass distribution about a perimeter of the rotor whereby rotation of the rotor results in eccentric rotation;

rotating the harvester tool in an eccentric motion in the wellbore rotating the magnet around the center of the harvester tool; and inducing a voltage in the stator, wherein rotation of the rotor induces the voltage in the stator.

10. The method of claim 9, further comprising rotating the rotor about the stator.

11. The method of claim 9, further comprising providing the rotor with a plurality of magnets.

12. The method of claim 9, further comprising providing the rotor with an eccentric mass, wherein the eccentric mass is disposed eccentric to the center of the harvester tool.

13. The method of claim 9, wherein rotation of the drill string rotates the harvester tool.

14. The method of claim 9, wherein the uneven mass distribution causes any rotation of the rotor to be eccentric with respect to the stator.

15. The method of claim 10 wherein the magnet is positioned on the perimeter of the rotor such that the rotor has the uneven mass distribution.

16. The method of claim 9, further comprising a second magnet disposed on the perimeter rotor such that a mass distribution of the rotor is unbalanced and the rotor rotates eccentrically.

17. The method of claim 9, further comprising determining a power output of the harvester tool for the load torque, wherein the power output is determined by:

$$P_{max}=T_1\omega_2(1+(R_C/R_B)^2),$$

wherein $P_{max}$ is the power output of the harvester tool, and $\omega_2$ is angular velocity of the magnet around the center of the harvester tool.

18. The method of claim 9, wherein the magnet creates the uneven mass distribution, and the uneven mass distribution causes eccentric rotation of the rotor with respect to the stator.

19. The method of claim 9, wherein the uneven mass distribution includes a first mass about a substantial portion of the perimeter of the rotor and a second mass about a remaining portion of the perimeter of the rotor and further wherein the first mass is different than the second mass.

20. The method of claim 9, further comprising increasing a weight of the magnet to increase a power output of the harvester tool.

* * * * *